United States Patent [19]

Grillo

[11] 4,034,902

[45] July 12, 1977

[54] LINE ENGAGING GARMENT HANGER

[76] Inventor: Doris Grillo, 51 Brookdale Gardens, Bloomfield, N.J. 07003

[21] Appl. No.: 706,239

[22] Filed: July 19, 1976

[51] Int. Cl.[2] ..... A47J 51/095

[52] U.S. Cl. ..... 223/85; 223/92; 248/340

[58] Field of Search ..... 223/85, 87, 88, 92, 223/95; 248/339, 340, 304, 305

[56] References Cited

U.S. PATENT DOCUMENTS

| | | | |
|---|---|---|---|
| 3,139,260 | 6/1964 | Hamel | 248/340 |

FOREIGN PATENT DOCUMENTS

| | | | |
|---|---|---|---|
| 152,197 | 11/1955 | Sweden | 223/85 |
| 193,546 | 1/1938 | Switzerland | 248/305 |
| 4,365 | 7/1914 | United Kingdom | 223/85 |

*Primary Examiner*—George H. Krizmanich
*Attorney, Agent, or Firm*—Eugene V. Mandel

[57] ABSTRACT

A garment hanger including support means dimensioned to engage and support garments suspended thereon, a vertical neck element fixedly secured to the support means, a hook element fixedly secured to the vertical neck element, a rigid tongue fixedly secured to an inner edge of the hook element, and a pivotal tongue hingedly affixed to an inner edge of the hook element, the tongues falling in substantially the same plane as the hook element, the pivotal tongue being urged toward the rigid tongue. When the hooked element is placed over a support such as a clothes line or the like, a portion of the inner edge of the hooked element and the tongues enclose the support and removably secure the garment hanger thereon.

7 Claims, 4 Drawing Figures

LINE ENGAGING GARMENT HANGER

BACKGROUND OF THE INVENTION

1. Field of the Invention

The present invention relates to garment hangers, and more particularly, to a garment hanger configured to prevent an accidental disengagement from a support such as a clothes line or the like.

2. Description of the Prior Art

The need for garment hangers providing means to prevent accidental disengagement from a clothes line or the like has been long standing. This need is particularly realized when garments are hung outdoors on a breezy day. Previously disclosed garment hangers incorporating this feature may be characterized as cumbersome and expensive to manufacture.

U.S. Pat. No. 1,817,621 issued to M. L. Harding on Aug. 4, 1931 discloses a garment hanger including a hook element and a spring urged plunger adapted to prevent unwanted removal of the hook element from a support.

U.S. Pat. No. 2,876,938 issued to E. Margolin on March 10, 1959 teaches a coat hanger including a hook element and a detaining bar pivotally affixed thereto to prevent accidental disengagement of the hook element from a support.

The present invention overcomes the shortcomings associated with the prior art by providing a garment hanger which prevents accidental disengagement from a support, may easily and quickly be engaged and disengaged therefrom, and is inexpensive to manufacture.

SUMMARY OF THE INVENTION

Therefore, it is a primary object of the present invention to provide a garment hanger which prevents accidental disengagement from a support.

A further object is to provide a garment hanger which may easily and quickly be engaged and disengaged from a support such as a clothes line or the like.

A still further object is to provide a garment hanger which is ideally suited to unitary construction by injection molding or similar one piece fabrications.

Another object is to provide a garment hanger which is simple in design, inexpensive to manufacture and durable.

These objects, as well as further objects and advantages, of the present invention will become readily apparent after reading the description of a non-limiting illustrative embodiment and the accompanying drawing.

According to the principles of the present invention there is provided a garment hanger including support means dimensioned to engage and support garments suspended thereon; a substantially vertical neck element fixedly secured on one end thereof to the support means proximate the central portion thereof; a hook element fixedly secured on one of end thereof to theoother end of the vertical neck element, the hook element adapted to engage and partially circumscribe a support when placed thereon; a rigid tongue fixedly secured to a fixed portion of the inner edges of the hook element, the tongue falling in the same plane as the hook element and extending in a horizontal plane substantially perpendicular to the vertical neck element; and a pivotal tongue hingedly affixed on one end thereof to a second portion of the inner edge of the hook element, the second portion being opposite the first portion, the pivotal tongue being urged into a position adjacent and substantially parallel to the rigid tongue, the pivotal and rigid tongues and the inner edge removably enclosing the support therein when the hook element is placed thereon.

BRIEF DESCRIPTION OF THE DRAWING

In order that the present invention may be more fully understood it will now be described, by way of example, with reference to the accompanying drawings in which.

DETAILED DESCRIPTION OF THE PREFERRED EMBODIMENT

Figure 1:
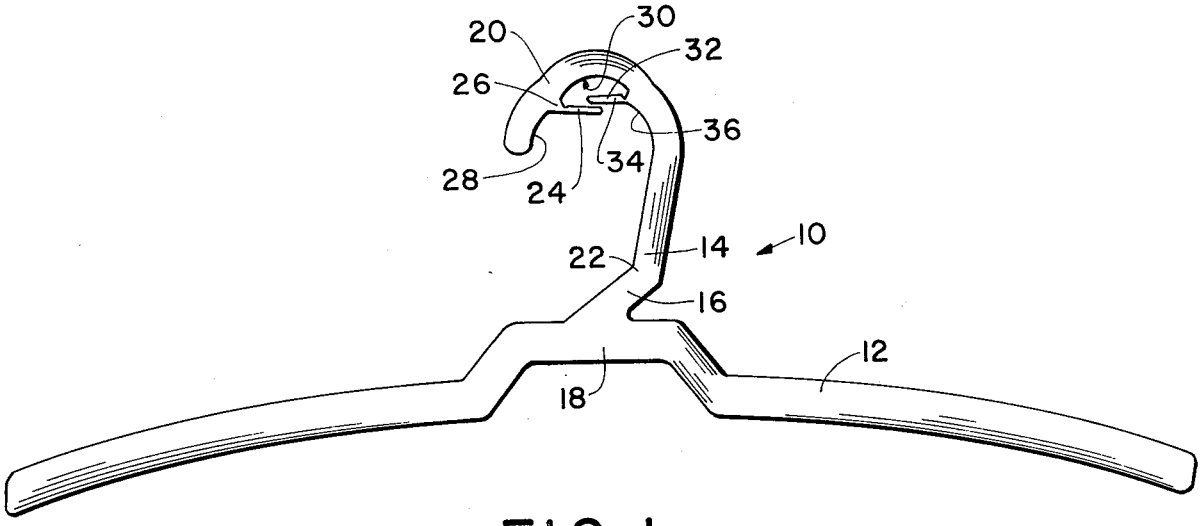
FIG. 1 is a front view of the preferred embodiment incorporating the principles of the present invention.

Referring now to the figures, and more particularly to FIG. 1, there is illustrated therein a garment hanger 10. The garment hanger 10 includes a substantially horizontal cross bar 12 dimensioned to engage and support garments thereon. A substantially vertical neck element 14 is fixedly secured on an end 16 thereof to the cross bar 12 adjacent the central portion 18 thereof. A hook element 20 is fixedly secured on an end 22 thereof to the neck element 14. The hook element 20 is adapted to engage and partially circumscribe a support such as a clothes line or the like when placed thereon.

A rigid tongue 24 is fixedly secured on an end 26 thereof to a first portion 28 of the inner edge 30 of the hook element 20. The rigid tongue element 24 falls in the same plane as the hook element 20 and extends in a horizontal plane substantially perpendicular to the neck element 14.

Figure 2:
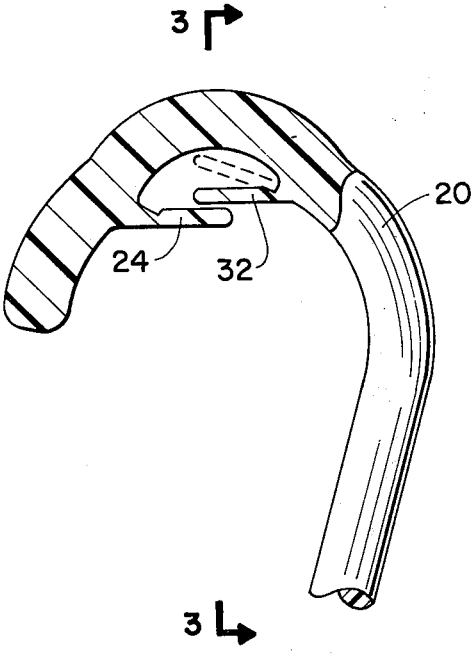
FIG. 2 is a fragmentary front view of the hook element of the preferred embodiment.

A pivotal tongue 32 is hingedly affixed on an end 34 thereof to a second portion 36 of the inner edge 30 of the hook element 20 as shown in FIG. 2. The second portion 36 is substantially opposite the first portion 28. The pivotal tongue 32 is positioned adjacent and substantially parallel to the rigid tongue 24.

The horizontal cross bar 12, the vertical neck element 14, the hook element 20, the rigid tongue element 24, and the pivotal tongue 32 are preferably formed in one piece by injection molding or a similar process.

Figure 3:
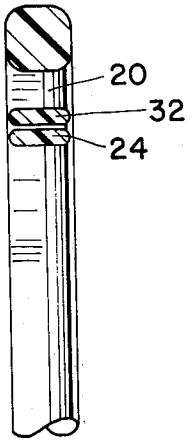
FIG. 3 is a side sectional view taken substantially along the lines 3—3 of FIG. 2.

FIG. 2 and 3 illustrates the hook element 20. The pivotal tongue 32 is integrally formed as part of the hook element 20. The portion 38 of the pivotal tongue 32 functions as a "living" hinge and urges the pivotal tongue 32 toward the rigid tongue element 24.

When the hook element 20 is placed over a clothes line or the like the pivotal tongue element 32 is urged by the clothes line toward the inner edge 30 of the hook element 20. After the clothes line passes the rigid tongue element 24 the pivotal tongue element 32 moves back thereadjacent removably enclosing the clothes line. To remove the garment hanger 10 from the clothes line, the user simply places slight finger pressure on the pivotal tongue 32 to open a passage between the tongues 24 and 32.

Figure 4:
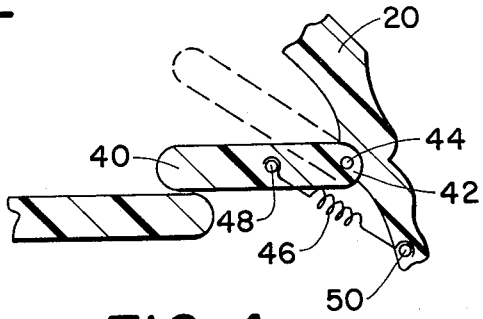
FIG. 4 is a fragmentary view of the hook element and can alternate pivotal tongue affixed thereto.

FIG. 4 illustrates an alternate method of fabricating the pivotal tongue 32. A pivot element 40 is pivotally secured on an end 42 thereof to the hook element 20 by a pivot 44. The pivot element 40 is urged against the rigid tongue 24 by a helical coil spring 46. The helical coil spring 46 is fixedly secured on one end 48 thereof to the pivot element 40 and on the other end 50 thereof to the hook element 20.

It will be understood that various changes in the details, materials, arrangements of parts and operation conditions which have been herein described and illustrated in order to explain the nature of the invention may be made by those skilled in the art within the principles and scope of the invention.

I claim:

1. A garment hanger comprising:

a first support means dimensioned to engage and support garments suspended thereon;

a substantially vertical neck element fixedly secured on one end thereof to said support means proximate the central portion thereof;

a hook element fixedly secured on one end thereof to the other end of said vertical neck element, said hook element adapted to engage and partially circumscribe a support when placed thereon;

a rigid tongue fixedly secured to a first portion of the inner edge of said hook element, said tongue falling in the same plane as said hook element and extending away from said first portion and;

a pivotal tongue hingedly affixed on one end thereof to a second portion of the inner edge of said hook element, and extending away from said second portion and towards said first portion, said pivotal tongue being urged into a position adjacent to said rigid tongue, such that the free ends of the tongues overlap, said pivotal and said rigid tongues and said inner edge removably enclosing said support therein when said hook element is placed thereon.

2. A garment hanger according to claim 1, wherein said first support means comprises a substantially horizontal cross bar.

3. A garment hanger according to claim 1, wherein said rigid tongue is fixedly secured adjacent said free end of said hook element, and said pivotal tongue is hingedly secured to said hook element adjacent said neck element.

4. A garment hanger according to claim 1, wherein said pivotal tongue is affixed to said hook element by a self urged integrally formed hinge.

5. A garment hanger according to claim 1, wherein said pivotal tongue is affixed to said hook element by a pivot, said pivot retaining said pivotal tongue thereon.

6. A garment hanger according to claim 1, wherein said pivotal tongue is urged toward said rigid tongue by spring bias means.

7. A garment hanger according to claim 1, wherein said spring bias means comprises a helical coil spring fixedly secured on one end thereof to said pivotal tongue, the other end of said spring being fixedly secured to said hook element.

* * * * *